US006692505B1

(12) United States Patent
Maier et al.

(10) Patent No.: US 6,692,505 B1
(45) Date of Patent: Feb. 17, 2004

(54) SKIN CARE DEVICE WITH A CLEANING TOOL COMPRISING A PADDING CONFIGURATION CONSISTING AT LEAST IN PART OF A MICROFIBER TISSUE

(75) Inventors: Michael Maier, München (DE); Arthur Putzer, Bad Eisenkappel (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/561,476

(22) Filed: Apr. 27, 2000

(30) Foreign Application Priority Data

Apr. 29, 1999 (EP) ..... 99890137

(51) Int. Cl.[7] ..... A61B 17/50

(52) U.S. Cl. ..... 606/131

(58) Field of Search ..... 606/131, 136–142

(56) References Cited

U.S. PATENT DOCUMENTS

| | | | | | |
|---|---|---|---|---|---|
| 1,919,571 | A | * | 7/1933 | Pinkston | 601/112 |
| 3,910,284 | A | * | 10/1975 | Orentreich | 132/333 |
| 4,378,804 | A | * | 4/1983 | Cortese, Jr. | 15/23 |
| 4,655,232 | A | * | 4/1987 | Ficke | 132/286 |
| 4,769,022 | A | * | 9/1988 | Chang et al. | 604/368 |
| 5,041,123 | A | * | 8/1991 | Oliveau et al. | 606/133 |
| 5,187,827 | A | * | 2/1993 | Wei | 15/22.1 |
| 6,017,351 | A | * | 1/2000 | Street | 606/131 |
| 6,139,553 | A | * | 10/2000 | Dotan | 601/70 |

* cited by examiner

*Primary Examiner*—Michael J. Milano
*Assistant Examiner*—Victor Nguyen
(74) *Attorney, Agent, or Firm*—Ernestine C. Bartlett

(57) ABSTRACT

A skin care device (1) includes a cleaning tool (18) which can be driven by a driving mechanism (8). The device also includes a drivable padding holder (19) and a padding configuration (31) retained by the padding holder (19). The configuration includes a padding interior (23), which is enveloped in a padding cover (24). The cover (24) may consist of a microfiber tissue material.

7 Claims, 2 Drawing Sheets

SKIN CARE DEVICE WITH A CLEANING TOOL COMPRISING A PADDING CONFIGURATION CONSISTING AT LEAST IN PART OF A MICROFIBER TISSUE

The invention relates to a skin care device as defined in the preamble of claim 1.

BACKGROUND OF THE INVENTION

Such a skin care device of the kind mentioned in the opening paragraph is commercially available and is accordingly generally known. The housing of the known skin care device is of elongate shape, the cleaning tool being provided substantially perpendicularly to the longitudinal direction of the housing, projecting therefrom, in a region of a housing end. The cleaning tool comprises a substantially circular padding holder which can be driven into rotation and to which a cleaning padding, which constitutes the padding configuration, is connected, which padding consists of a soft felt-type material. The cleaning padding is provided first and foremost for cleaning skin regions of a human face, which cleaning is advantageous in particular after a treatment of the facial skin with water vapor, for example by means of a so-called facial sauna. It was found with the known skin care device that skin particles detached from the skin and dirt particles detached from the skin penetrate comparatively deeply into the cleaning padding as a result of the felt-type nature of the cleaning padding in the case of a longer use of the skin care device, which has the result that it is at least very cumbersome to clean the cleaning padding to such an extent that it is restored to a perfect hygienic state again. In addition, it was found with the known skin care device that the padding material is comparatively strongly and quickly worn away, which is also undesirable.

SUMMARY OF THE INVENTION

The invention has for its object to avoid the problems described above and to improve a skin care device as mentioned in the opening paragraph by simple means and in a simple manner, so as to provide an improved skin care device with which a faultless cleaning function is maintained also after a longer period of use, while a comparatively strong pollution of the padding is avoided.

To achieve the above object, a skin care device is provided that is constructed for cleaning skin regions, in particular skin regions of a human face, The measures according to the invention achieve in a very simple manner that a highly satisfactory cleaning of the skin is safeguarded at all times. It should be noted here that so-called microfiber tissues have proved their eminent suitability for cleaning purposes in the home for some time. The idea, however, to utilize such a microfiber tissue also for cleaning purposes in a skin care device has never before arisen. A further advantage of the cleaning tool with padding regions made of microfiber tissue for the purpose of making contact with skin regions lies in the fact that it is possible to carry out a so-called moisture treatment during operation of the skin care device, i.e. in that the microfiber tissue is moistened.

A skin care device according to the invention may be so constructed that the entire padding configuration consists of a microfiber tissue, which is preferably directly connected to the padding holder. It is particularly preferred, however, when the padding configuration comprises a padding interior and a padding cover, the padding interior is enveloped by the padding cover, and the padding cover is made from a microfiber tissue material. Such a construction is advantageously inexpensive. The use of a padding cover of a microfiber tissue in such a construction has the advantage, furthermore, that the penetration of dirt particles and/or skin particles into the region of the padding interior of the cleaning tool is reduced to an advantageously small amount, so that also a perfect cleaning of the cleaning tool is safeguarded at all time. Such a cleaning may take place, for example, in a washing machine.

In preferred embodiments of a skin care device according to the invention, a skin care device is provided in which

- the padding configuration comprises a padding interior and a padding cover, and/or
- the padding interior is enveloped by the padding cover, and the padding cover is made from a microfiber tissue material; and/or
- the padding interior is made from a soft and compressible material, and the padding interior is held by the padding cover in a compressed operational state as compared with its non-compressed initial state; and/or
- the padding interior is made of a foam material; and/or
- the padding interior is made of a felt-type material; and/or
- the padding interior comprises a pluratily of brushes; and/or
- the padding cover of the padding configuration has an entrance region through which the padding interior and the padding cover can be joined together, and the said entrance region of the padding cover is closed off by the padding holder when the padding configuration is being retained by the padding holder. It is to be noted with reference to a soft and compressible padding interior that a particularly pleasant sensation or feeling is achieved during cleaning of facial skin regions by means of such a padding interior. It is quite possible, however, to provide a padding interior consisting of a comparatively hard material instead of a soft, compressible padding interior in a skin care device according to the invention, for example a padding interior of a synthetic resin material or a hard rubber which is enveloped in a padding cover of microfiber tissue.

The above and further aspects of the invention will become apparent from the description of an embodiment given below and are explained in more detail with reference to this embodiment.

BRIEF DESCRIPTION OF THE DRAWINGS

The invention will now be explained in more detail below with reference to three embodiments shown in the drawings, and a further embodiment not shown in the drawings; however, the invention is by no means limited to these embodiments.

DESCRIPTION OF THE PREFERRED EMBODIMENTS

Figure 1:
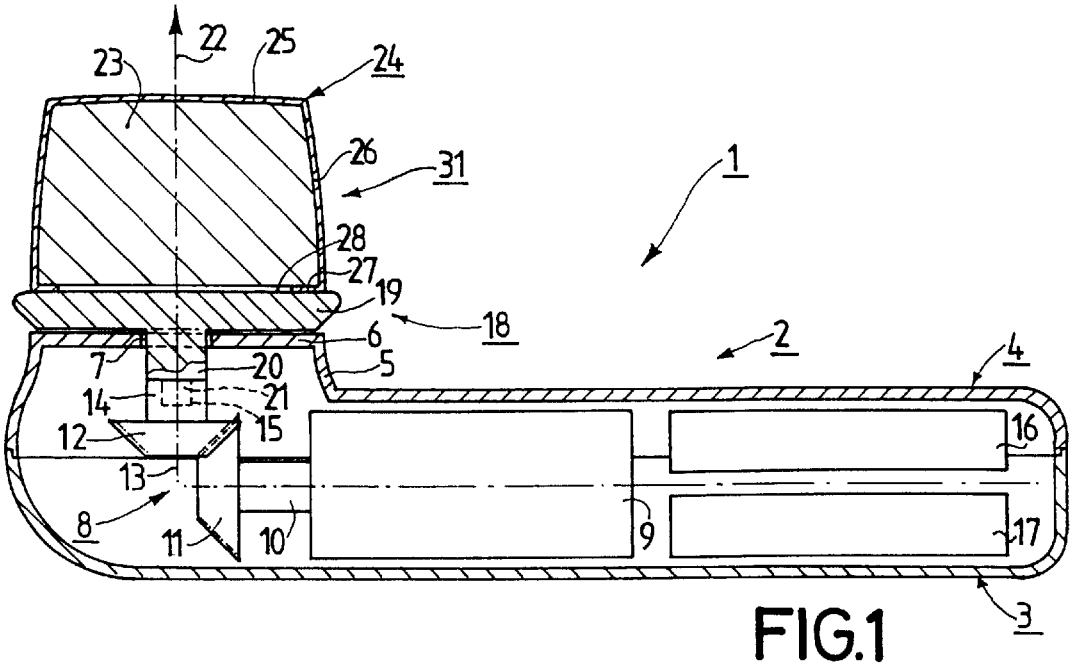
FIG. 1 is a diagrammatic cross-sectional view of a skin care device representing a first embodiment of the invention, which comprises a cleaning tool with a padding interior consisting of a foam material.

FIG. 1 shows a skin care device 1 which is designed and constructed for the cleaning of skin regions, in particular skin regions of a human face. The skin care device 1 comprises a housing 2 which consists of a substantially tub-type lower housing part 3 and an also substantially tub-type upper housing part 4. The upper housing part 4 is provided on the lower housing part 3 and is connected to the lower housing part 3 in a manner not shown in any detail. The upper housing part 4 comprises a substantially annular projecting housing region 5 which is closed off at its end facing away from the lower housing part 3 by means of a housing cover wall 6. A passage 7 is provided in the housing cover wall 6, the purpose of which will be explained further below. The housing 2 has a substantially elongate shape in its region adjoining the annular housing portion 5, whose dimensions and shape are chosen such that the housing 2 can be comfortably held in one hand.

Drive means 8 for driving a cleaning tool are accommodated in the housing 2. The drive means 8 comprise a motor 9, indicated diagrammatically, and a first miter gear 11 which can be driven by the motor 9 by means of a drive shaft 10 of the motor 9. A second miter gear 12 of the drive means 8 is in engagement with the first miter gear 1I. The second miter gear 12 is journaled so as to be rotatable about an axis 13 and is connected to an output shaft 14 which is coaxial with the axis 13 and which comprises a recess 15 which is of a square shape as viewed in a cross-section perpendicular to the axis 13. A worm gear or a contrate gear may be provided instead of a miter gear.

Two rechargeable batteries 16 and 17 are provided in the housing 2 of the skin care device 1 for supplying the motor 9, which batteries are electrically connected to the motor a in a manner not shown in any detail and which batteries are further electrically connected to charging contacts through which the two rechargeable batteries 16 and 17 can be charged by means of a charging device (not shown). Replaceable, non-chargeable batteries may be provided instead of the rechargeable batteries 16 and 17.

The skin care device 1 is fitted with a cleaning tool 18. The cleaning tool 18 can be driven by the drive means 18, i.e. in this case can be driven into rotation in a single direction of rotation. Alternatively, however, means may be present for selecting either of two directions of rotation. The cleaning tool 18 comprises a drivable padding holder 19. The padding holder 19 is provided with an input shaft 20 which extends through the passage 7 in the housing cover wall 6 and which comprises an extension 21 which has a square cross-sectional shape, as viewed perpendicularly to the axis 13, corresponding to the square shape of the recess 15 in the output shaft 14 of the second miter gear 12. The extension 21 is retained in the recess 15 by means of friction. By gripping the padding holder 19 and pulling the padding holder 19 in the direction of an arrow 22, it is possible to pull the extension 21 from the recess 15 and thus to separate the padding holder 19, and accordingly the entire cleaning tool 18, from the remaining part of the skin care device 1, for example for cleaning the cleaning tool 18 or replacing the cleaning tool 18 with another cleaning tool.

The cleaning tool 18 furthermore comprises a padding configuration 31 retained by means of the padding holder 19. Highly advantageously, the padding configuration 31 consists of a microfiber tissue in those of its padding regions which are designed for making contact with regions of the skin. In the present case, the padding configuration 31 comprises a padding interior 23 of a foam material. The padding interior 23 is enveloped in a padding cover 24 in the skin care device 1 in a highly advantageous manner, said padding cover 24 advantageously consisting of a microfiber tissue material.

The padding interior 23 consists of a foam material, as noted above, i.e. a soft and compressible material. The padding interior 23 and the padding cover 24 are so designed here that the padding interior 23 is held inside the padding cover 24 in an operational state which is a compressed state as compared with its non-compressed initial state. This offers the advantage that the padding interior 23 always strives to extend its volume, which is counteracted, however, by the padding cover 24, so that the padding cover 24 is always held in a state which offers a tensioned, homogeneously smooth surface. It is also safeguarded thereby that the padding interior 23 offers a somewhat increased mechanical resistance as compared with its non-compressed initial state, which has been found to be favorable for the cleaning of skin regions.

The padding cover 24 comprises an upper region 25 facing away from the padding holder 19 and having a slightly convex shape, and a sleeve-shaped lateral region 26 which is integral with the upper region 25. An annular lower region 27 is integral with the sleeve-shaped lateral region 26. The lower region 27 is glued to the padding holder 19. The provision of the annular lower region 27 achieves that the padding cover 24 has an entrance region 28. The padding interior 23 and the padding cover 24 can be joined together by means of this entrance region 28, i.e. in that the, padding interior 23 is introduced into the inner space of the padding cover 24 with a careful widening of the padding cover 24 in the region of its annular lower region 27. The entrance region 28 of the padding cover 24, however, by no means impairs the protective function of the padding cover 24 because the skin care device 1 is so designed that the entrance region 28 of the padding cover 24 is closed off by the padding holder 19 when the padding interior 23 is enveloped by the padding holder 19.

The skin care device 1 achieves a particularly good cleaning effect by means of its padding cover 24 of a microfiber tissue material because such a microfiber tissue material has been found to be particularly advantageous for cleaning purposes, as has been known from other fields of application, for example in the kitchen. Furthermore, the provision of the padding cover 24 of microfiber tissue in the skin care device 1 advantageously provides a high degree of protection for the padding interior 23 of foam material: The padding cover 24 consisting of microfiber tissue also protects the padding interior 23 of foam material against excessive pollution, so that a comparatively simple cleaning of the cleaning tool 18 is safeguarded at all times.

Figure 2:
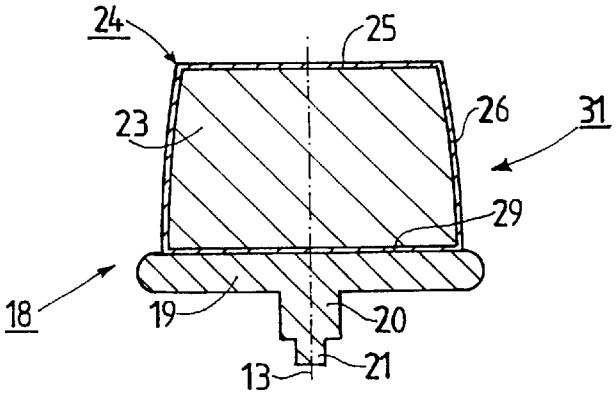
FIG. 2 shows a cleaning tool which forms part of a second embodiment of a skin care device according to the invention and which comprises a padding interior consisting of a felt-type material.

It is noted with reference to the cleaning tool 18 shown in FIG. 2 and belonging to a skin care device which is not shown that this cleaning tool 18 comprises a padding interior 23 of a felt-type material, and that it is so designed that the upper region 25 is substantially planar in shape and extends substantially parallel to the padding holder 19. It should also be noted with reference to the cleaning tool 18 of FIG. 2 that the padding cover 24 of this cleaning tool 18 has a continuous lower region 29 which is, glued to the padding holder 19.

Figure 3:
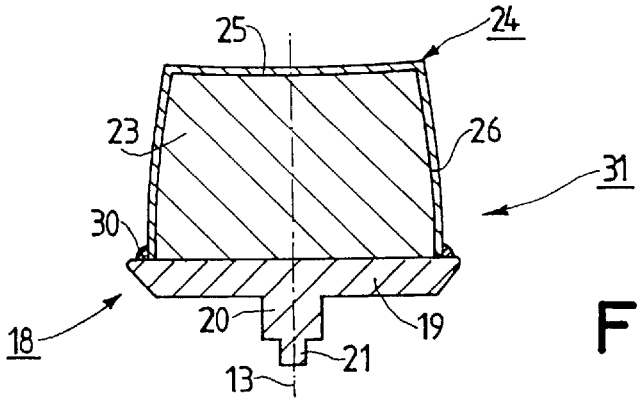
FIG. 3 shows a cleaning tool which forms part of a third embodiment of a skin care device according to the invention and which comprises a padding interior consisting of a solid synthetic resin material.

The cleaning tool 18 shown in FIG. 3 and belonging to a skin care device which is not shown has the feature that this cleaning tool 18 comprises a padding interior 23 of a solid synthetic resin material, and that the padding interior 23 in this cleaning tool 18 is so designed that the upper region 25 of the padding cover 24 has a slightly concave shape. It should also be noted here that the padding cover 24 of the cleaning tool 18 of FIG. 3 does not have a lower region, but instead the substantially sleeve-shaped lateral region 26 lies and is retained against the padding holder 19 at its end, an annular glue connection 30 being provided here for connecting the sleeve-shaped lateral region 26 to the padding holder 19.

Figure 4:
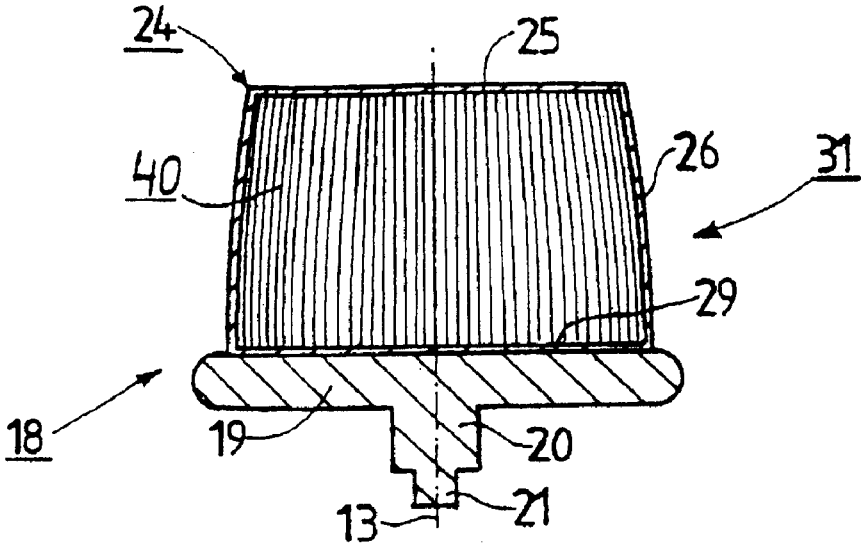
FIG. 4 shows a cleaning tool which forms part of a third embodiment of the skin care device according to the invention and which comprises a padding interior with brush-type material.

In a skin care device as shown in FIG. 4, the padding interior 40 enveloped by the microfiber tissue padding cover 26 is realized in the form of a plurality of brushes 40. The brushes 40 are here retained in the padding holder 19 and project substantially perpendicularly from the padding holder 19, said brushes being concentrated at their ends at 25 facing away from the padding holder 19 by means of the padding cover 24 into a narrower space than is the case at the side of the padding holder 19.

The invention is not limited to the embodiments described above. For example, a skin care device according to the invention may alternatively be fitted with two or more cleaning tools, each of them comprising a padding interior which is coated with a padding cover of microfiber tissue. Furthermore, a skin care device according to the invention may also be so constructed that the padding holder, and accordingly the padding interior retained by the padding holder and enveloped in the padding cover of microfiber tissue, can be driven alternately in mutually opposed directions of rotation, so that then an alternatingly driven rotation of the padding configuration is obtained, which configuration in this case may be entirely formed by microfiber tissue material.

What is claimed is:

1. A skin care device constructed for cleaning skin regions, in particular skin regions of a human face, comprising a housing, comprising drive means in the housing for driving a cleaning tool, and fitted with a cleaning tool which can be driven by the drive means, which cleaning tool comprises a drivable padding holder and a padding configuration retained by said padding holder, wherein the padding configuration consists of a microfiber tissue material at least in padding regions which are designed to make contact with skin regions.

2. A skin care device as claimed in claim 1, wherein the padding configuration comprises a padding interior and a padding cover, the padding interior is enveloped by the padding cover, and the padding cover is made from a microfiber tissue material.

3. A skin care device as claimed in claim 2, wherein the padding interior is made from a soft and compressible material, and in that the padding interior is held by the padding cover in a compressed operational state as compared with its non-compressed initial state.

4. A skin care device as claimed in claim 2, wherein the padding interior is made of a foam material.

5. A skin care device as claimed in claim 2, wherein the padding interior is made of a felt-type material.

6. A si care device as claimed in claim 2, herein the padding interior comprises a plurality of brushes.

7. A skin care device as claimed in claim 2, wherein the padding cover of the padding configuration has an entrance region through which the padding interior and the padding cover can be joined together, and said entrance region of the padding cover is closed off by the padding holder when the padding configuration is being retained by the padding bolder.

* * * * *